US008395325B2

(12) United States Patent
Ye et al.

(10) Patent No.: US 8,395,325 B2
(45) Date of Patent: Mar. 12, 2013

(54) METHOD OF DRIVING A LIGHT SOURCE, LIGHT SOURCE APPARATUS FOR PERFORMING THE METHOD, AND DISPLAY APPARATUS HAVING THE LIGHT SOURCE APPARATUS

(75) Inventors: Byoung-Dae Ye, Yongin-si (KR); Gi-Cherl Kim, Yongin-si (KR); Byung-Choon Yang, Seoul (KR); Se-Ki Park, Suwon-si (KR); Sang-Chul Byun, Anyang-si (KR)

(73) Assignee: Samsung Display Co., Ltd. (KR)

( * ) Notice: Subject to any disclaimer, the term of this patent is extended or adjusted under 35 U.S.C. 154(b) by 589 days.

(21) Appl. No.: 12/556,320

(22) Filed: Sep. 9, 2009

(65) Prior Publication Data

US 2010/0194299 A1 Aug. 5, 2010

(30) Foreign Application Priority Data

Feb. 5, 2009 (KR) ..... 10-2009-0009212

(51) Int. Cl.

| | |
|---|---|
| ***H05B 37/00*** | (2006.01) |
| ***H05B 39/00*** | (2006.01) |
| ***H05B 41/00*** | (2006.01) |
| ***G09G 3/32*** | (2006.01) |

(52) U.S. Cl. ..... 315/192; 315/122; 315/185 R; 345/82

(58) Field of Classification Search ..... 315/192, 315/121, 122, 185 R, 193, 191, 250, 307, 315/282, 297, 201; 345/82

See application file for complete search history.

(56) References Cited

U.S. PATENT DOCUMENTS

| | | | | |
|---|---|---|---|---|
| 6,621,235 | B2 * | 9/2003 | Chang | 315/216 |
| 7,265,504 | B2 * | 9/2007 | Grant | 315/308 |
| 7,759,881 | B1 * | 7/2010 | Melanson | 315/307 |
| 7,843,148 | B2 * | 11/2010 | Gater et al. | 315/291 |
| 7,880,404 | B2 * | 2/2011 | Deng et al. | 315/291 |
| 7,919,928 | B2 * | 4/2011 | Ziegenfuss | 315/227 R |
| 8,022,634 | B2 * | 9/2011 | Greenfeld | 315/192 |
| 8,106,602 | B2 * | 1/2012 | Ye et al. | 315/294 |
| 8,159,139 | B2 * | 4/2012 | Blaut et al. | 315/185 R |
| 8,237,379 | B2 * | 8/2012 | Liu | 315/307 |
| 2007/0046485 | A1 * | 3/2007 | Grootes et al. | 340/815.45 |
| 2008/0224625 | A1 * | 9/2008 | Greenfeld | 315/201 |
| 2009/0096739 | A1 * | 4/2009 | Lan et al. | 345/102 |
| 2009/0146584 | A1 * | 6/2009 | Ye et al. | 315/294 |
| 2009/0225021 | A1 * | 9/2009 | Ye et al. | 345/102 |
| 2009/0261743 | A1 * | 10/2009 | Chen et al. | 315/192 |
| 2010/0141163 | A1 * | 6/2010 | Ye et al. | 315/189 |
| 2010/0225249 | A1 * | 9/2010 | Liao et al. | 315/297 |
| 2010/0289424 | A1 * | 11/2010 | Chang et al. | 315/250 |
| 2010/0320934 | A1 * | 12/2010 | Liu et al. | 315/294 |
| 2011/0012512 | A1 * | 1/2011 | Young et al. | 315/117 |
| 2011/0080112 | A1 * | 4/2011 | Shearer et al. | 315/291 |
| 2011/0148314 | A1 * | 6/2011 | Lin et al. | 315/192 |

* cited by examiner

*Primary Examiner* — Shawki Ismail
*Assistant Examiner* — Dylan White
(74) *Attorney, Agent, or Firm* — Innovation Counsel LLP

(57) ABSTRACT

A method of driving a light source, a light source apparatus for performing the method, and a display apparatus having the light source apparatus are disclosed in accordance with one or more embodiments. In the method, a plurality of light source strings connected in parallel is driven by applying a driving voltage to a first terminal of the light source strings. A peak current due to a voltage deviation of each of the light source strings is switch-controlled to uniform an average current of the light source strings. Thus, a peak current flowing through light source strings in accordance with a voltage deviation of the light source strings is switch-controlled, so that an average current of the light source strings may be uniformly maintained. Therefore, a voltage deviation is not consumed as power, so that damage to circuit elements due to heat may be prevented.

18 Claims, 6 Drawing Sheets

METHOD OF DRIVING A LIGHT SOURCE, LIGHT SOURCE APPARATUS FOR PERFORMING THE METHOD, AND DISPLAY APPARATUS HAVING THE LIGHT SOURCE APPARATUS

CROSS REFERENCE TO RELATED APPLICATIONS

This application claims priority under 35 U.S.C. §119 to Korean Patent Application No. 2009-9212, filed on Feb. 5, 2009 in the Korean Intellectual Property Office (KIPO), the contents of which are herein incorporated by reference in their entirety.

BACKGROUND

1. Technical Field

Example embodiments of the present invention relate to a method of driving a light source, a light source apparatus for performing the method, and a display apparatus that includes the light source apparatus. More particularly, example embodiments of the present invention relate to a method of driving a light source to stabilize the light source, a light source apparatus for performing the method, and a display apparatus that includes the light source apparatus.

2. Related Art

Generally, liquid crystal display (LCD) devices, among various flat panel display devices, have various advantages, such as thinness, lighter weight, lower driving voltage, and lower power consumption compared to other display devices, such as cathode ray tube (CRT) and plasma display panel (PDP) devices. As a result, LCD devices are widely employed for various electronic devices such as monitors, lap top computers, and cellular phones. The typical LCD device includes an LCD panel that displays an image using a light-transmitting ratio of liquid crystal molecules, and a backlight assembly disposed below the LCD panel to provide the LCD panel with light.

The backlight assembly includes a light source for emitting light. The light source may include, for example, any of a cold cathode fluorescent lamp (CCFL), a hot cathode fluorescent lamp (HCFL), or a light-emitting diode (LED). In general, the LED has low power consumption and high color reproducibility, so that the LED has been employed as a light source of the LCD device.

Recently, in order to prevent a contrast ratio of an image from being degraded, a method of local dimming a light source has been developed, which individually controls light amounts according to position to drive the light source. In the method of local dimming the light source, the light source is divided into a plurality of light-emitting blocks to control a light amount of the light-emitting blocks in correspondence with dark and white of a display area of the LCD panel corresponding to the light-emitting blocks. For example, driving current amounts provided to LEDs positioned at a dark area of an image may be decreased to decrease light amount, and driving current amounts provided to LEDs positioned at a bright area of an image may be increased to increase light amount.

When the backlight assembly employs a local dimming method using LEDs, the backlight assembly may include multiple strings of LEDs that are connected in parallel and a multi-channel current control circuit for providing the strings with a driving current. The strings may have a structure in which the LEDs are connected in series.

The multi-channel current control circuit generally consumes a voltage deviation between the LED strings as power to uniformly control driving currents flowing through the LED strings. Thus, damage to circuit elements may be generated due to heat produced from the multi-channel current control circuit.

SUMMARY

Example embodiments of the present invention provide a method of driving a light source for protecting the light source apparatus. Example embodiments of the present invention also provide a light source apparatus for performing the forementioned method. Example embodiments of the present invention further provide a display apparatus having the forementioned light source apparatus.

According to one embodiment of the present invention, there is provided a method of driving a light source. In the method, a plurality of light source strings connected in parallel are driven by applying a driving voltage to a first terminal of the light source strings. A peak current due to a voltage deviation (e.g., voltage difference) of each of the light source strings is switch-controlled to uniformly maintain an average current of the light source strings.

According to another embodiment of the present invention, a light source apparatus includes a light source module and a multi-channel current control part. The light source module includes a plurality of light source strings that are connected in parallel. The light source strings receive a driving voltage through a first terminal thereof. The multi-channel current control part is connected to a second terminal of each of the light source strings. The multi-channel current control part switch-controls a peak current due to a voltage deviation of the light source strings to uniformly maintain an average current of the light source strings.

According to still another embodiment of the present invention, a display apparatus includes a display panel, a light source module, and a multi-channel current control part. The display panel displays an image. The light source module includes a plurality of light source strings that are connected in parallel. The light source strings receive a driving voltage through a first terminal thereof. The multi-channel current control part is connected to a second terminal of each of the light source strings to uniformly maintain an average current of each of the light source strings by switch-controlling a peak current due to a voltage deviation of the light source strings.

According to one or more example embodiments of the present invention, a peak current flowing through light source strings in accordance with a voltage deviation of the light source strings is switch-controlled, so that an average current of the light source strings may be uniformly maintained. Therefore, a voltage deviation is not consumed as power, so that damage to circuit elements due to heat may be prevented.

BRIEF DESCRIPTION OF THE DRAWINGS

The above and other features and advantages of embodiments of the present invention will become more apparent by describing in detailed example embodiments thereof with reference to the accompanying drawings, in which.

DETAILED DESCRIPTION

Figure 1:
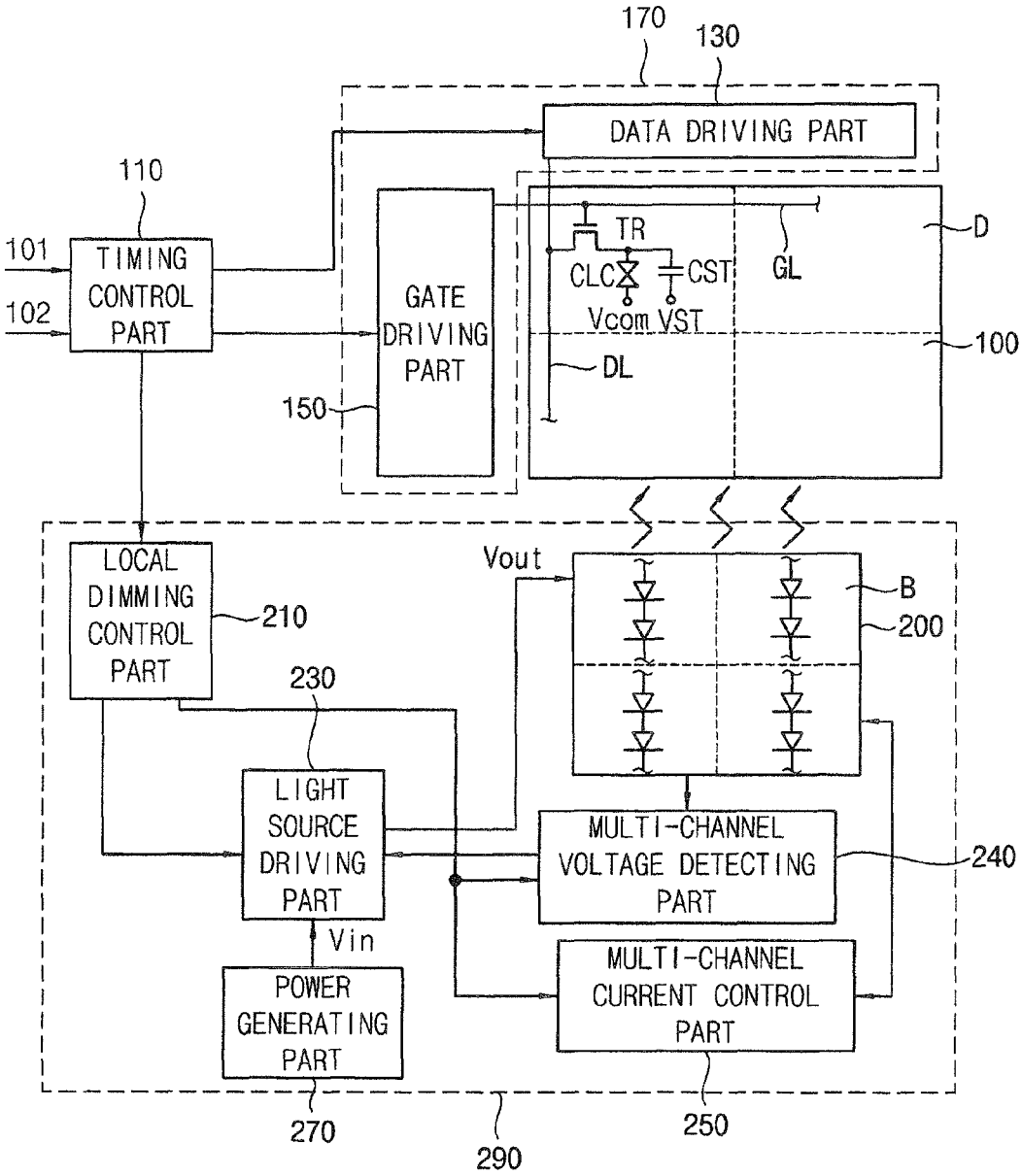
FIG. 1 is a block diagram of a display apparatus according to an embodiment of the present invention.

Embodiments of the present invention are described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention may be described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a discrete change from implanted to non-implanted region. Likewise, a buried region formed by implantation may result in some implantation in the region between the buried region and the surface through which the implantation takes place. Thus, the regions illustrated in the figures are schematic in nature, and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Hereinafter, embodiments of the present invention will be explained in detail with reference to the accompanying drawings.

FIG. 1 is a block diagram of a display apparatus according to an embodiment of the present invention. Referring to FIG. 1, a display apparatus according to an embodiment includes a display panel 100, a timing control part 110, a panel driving part 170, and a light source apparatus 290.

The display panel 100 includes a plurality of pixels for displaying an image. For example, the number of the pixels is M×N ('M' and 'N' are natural numbers). Each of the pixels P includes a switching element TR connected to a gate line GL and a data line DL, a liquid crystal capacitor CLC connected to the switching element TR, and a storage capacitor CST connected to the switching element TR.

The timing control part 110 receives a control signal 101 and an image signal 102 from an external device (not shown). The timing control part 110 generates a timing control signal for controlling a driving timing of the display panel 100 by using the control signal 101. The control signal 101 may include a vertical synchronizing signal, a horizontal synchronizing signal, and a clock signal. The timing control signal may include a clock signal, a horizontal start signal, and a vertical start signal.

The panel driving part 170 drives the display panel 100 in accordance with a control of the timing control part 110. The panel driving part 170 includes a data driving part 130 and a gate driving part 150.

The data driving part 130 drives the data line DL using a data control signal and an image signal provided from the timing control part 110. That is, the data driving part 130 converts the image signal into a data signal of an analog type and provides the data line DL with the converted data signal. The gate driving part 150 drives the gate line GL using a gate control signal provided from the timing control part 110. That is, the gate driving part 150 outputs a gate signal to the gate line GL.

The light source apparatus 290 includes a light source module 200, a local dimming control part 210, a light source driving part 230, a multi-channel voltage detecting part 240, a multi-channel current control part 250, and a power generating part 270.

The light source module 200 includes a plurality of light-emitting blocks B. Each of the light-emitting blocks B includes a light source string in which a plurality of light sources are connected in series. When the light source includes a light-emitting diode (LED), the light-emitting block includes a light-emitting diode string (hereinafter, 'LED sting') in which a plurality of LEDs are connected in series. The light source module 200 includes a first LED string LS1, a second LED string LS2, a third LED string LS3, and a fourth LED string LS4 that are connected in parallel.

The local dimming control part 210 divides the image signal into a plurality of image blocks D corresponding to the light-emitting blocks B and generates a dimming signal which controls a luminance of a light-emitting block B corresponding to a gradation of each of the image blocks. For example, the dimming signal may be a pulse width modulation (PWM) signal.

The light source driving part 230 boosts an input voltage into a driving voltage Vout and then provides the driving voltage Vout to a common terminal to which the first to fourth LED strings LS1, LS2, LS3, and LS4 are connected in parallel. The light source driving part 230 drives the light source module 200 so as to dim a light-emitting block B in response to the PWM signal that is provided from the local dimming control part 210.

The multi-channel voltage detecting part 240 is connected to a second terminal of the first to fourth LED strings LS1, LS2, LS3, and LS4. The multi-channel voltage detecting part 240 detects a voltage of the first to fourth LED strings LS1, LS2, LS3, and LS4 in synchronization with the PWM signal and provides the detected voltage (also referred to as "detection voltage") to the light source driving part 230 when the detection voltage is greater than a reference voltage. The light source driving part 230 may operate in a protection mode in response to a detection voltage that is greater than the reference voltage. For example, in protection mode, the light source driving part 230 may not provide the driving voltage Vout to the light source module 200. On the other hand, when the detection voltage is less than or equal to the reference voltage, the light source driving part 230 may be operated in a normal mode in which the reference voltage may be provided to the light source driving part 230.

The multi-channel current control part 250 is connected to the second terminal of the first to fourth LED strings LS1, LS2, LS3, and LS4. The multi-channel current control part 250 switch-controls a peak current deviation flowing through the first to fourth LED strings LS1, LS2, LS3, and LS4 in accordance with a voltage deviation of the first to fourth LED strings LS1, LS2, LS3, and LS4 in synchronization with the PWM signals to uniformly maintain an average current $I_{AVG}$ (see FIG. 4B and FIG. 5) of the first to fourth LED strings LS1, LS2, LS3, and LS4. The power generating part 270 provides the light source driving part 230 with an input voltage Vin.

Figure 2:
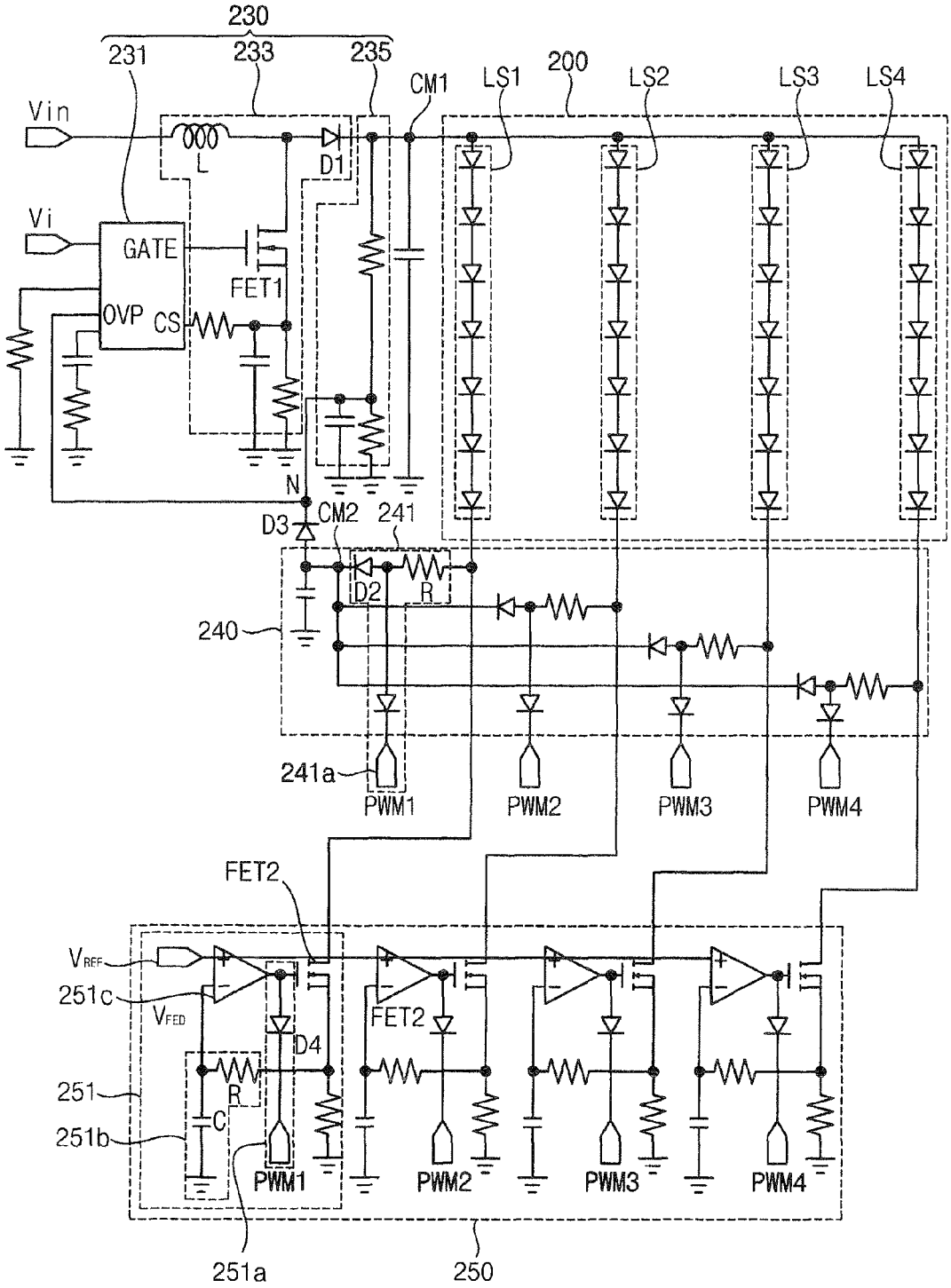
FIG. 2 is a detail circuit diagram illustrating a light source apparatus of FIG. 1 in accordance with an embodiment.

FIG. 2 is a detail circuit diagram illustrating a light source apparatus of FIG. 1 according to an embodiment. Referring to FIG. 1 and FIG. 2, the light source apparatus 290 includes a light source module 200, a light source driving part 230, a multi-channel voltage detecting part 240, and a multi-channel current control part 250.

The light source module 200 includes a plurality of LED strings, for example, a first LED string LS1, a second LED string LS2, a third LED string LS3, and a fourth LED string LS4. Each of the first to fourth LED strings LS1, LS2, LS3, and LS4 includes a plurality of LEDs.

The light source driving part 230 includes an integrated circuit 231, a boosting circuit 233, and a feedback circuit 235. The integrated circuit 231 includes a gate terminal GATE and a sensing terminal CS that are electrically connected to the boosting circuit 233. The integrated circuit 231 also includes a protection terminal OVP electrically connected to the feedback circuit 235. The integrated circuit 231 controls an operation of the boosting circuit 233 based on a sensing signal received through the sensing terminal CS. In addition, the integrated circuit 231 controls an operation of the integrated circuit 231 based on a signal received through the protection terminal OVP.

The boosting circuit 233 includes an inductor L, a boosting transistor FET1, and a first diode D1. A first terminal of the inductor L receives the input voltage Vin, and a second terminal of the inductor L is connected to an input electrode of the boosting transistor FET1. The boosting transistor FET1 includes a control electrode connected to the gate terminal GATE, an input electrode connected to the inductor L, and an output electrode connected to the sensing terminal CS. The first diode D1 includes an anode connected to the second terminal of the inductor L and a cathode connected to a first common terminal CM1 of the first to fourth LED strings LS1, LS2, LS3, and LS4.

When the boosting transistor FET1 is turned on, the inductor L stores the input voltage Vin as energy. When the boosting transistor FET1 is turned off, energy stored in the inductor L is boosted to the driving voltage Vout. The driving voltage Vout is applied to the first common terminal CM1 through the first diode D1.

The sensing terminal CS detects an output signal flow of an output electrode of the boosting transistor FET1, and the integrated circuit 231 controls an operation of the boosting circuit 233 in response to the detected output signal. For example, the integrated circuit 231 may turn off the boosting transistor FET1 when the output signal is greater than a reference voltage.

The feedback circuit 235 includes a resistor string connected to a second terminal of the first diode D1. The resistor string is connected to the protection terminal OVP of the integrated circuit 231 through a node 'N'. The output voltage Vout output from the boosting circuit 233 is divided through the resistor string, and the divided voltage is provided to the protection terminal OVP through the node N. When the detection voltage detected by the multi-channel voltage detecting part 240 is greater than the voltage at node N, the protection terminal OVP receives the detection voltage. When the detection voltage is less than or equal to the voltage at node N, the protection terminal OVP receives the node N voltage. Thus, the integrated circuit 231 is operated in protection mode when the detection voltage is received at the protection terminal OVP, and the integrated circuit 231 is operated in normal mode when the driving voltage Vout divided by the resistor string is received at the protection terminal OVP.

The multi-channel voltage detecting part 240 includes a plurality of detection circuits connected to the second terminals of the first to fourth LED strings LS1, LS2, LS3, and LS4 to detect a voltage of the first to fourth LED strings LS1, LS2, LS3, and LS4 in synchronization with PWM signals of the first to fourth LED strings LS1, LS2, LS3, and LS4.

For example, a first detection circuit 241 is connected to a second terminal of the first LED string LS1. The first detection circuit 241 includes a resistor R connected to a second terminal of the first LED string LS1 and a second diode D2 having an anode connected to the resistor R and a cathode connected to a second common terminal CM2. The first detection circuit 241 further includes an input part 241*a* to receive a PWM signal PWM1 corresponding to the first LED string LS1. The input part 241*a* is connected between the resistor R and the second diode D2. When the input part 241*a* receives a high level signal, a voltage of the first LED string LS1 is detected by the first detection circuit 241. When the input part 241*a* receives a low level signal, a voltage of the first LED string LS1 is not detected. Thus, multi-channel voltage detecting part 240 detects a voltage of the first to fourth LED strings LS1, LS2, LS3, and LS4 in synchronization with PWM signals of the first to fourth LED strings LS1, LS2, LS3, and LS4.

In the same manner, plural detection circuits, which are connected to second terminals of the second to fourth LED strings LS2, LS3, and LS4, are connected to the second common terminal CM2. The second common terminal CM2 is connected to the node N through a third diode D3. The third diode D3 includes an anode connected to the second common terminal CM2 and a cathode connected to the node N.

The multi-channel current control part 250 is connected to second terminals of the first to fourth LED strings LS1, LS2, LS3, and LS4. The multi-channel current control part 250 includes a plurality of current control circuits 251. The current control circuits 251 may detect peak currents flowing through the first to fourth LED strings LS1, LS2, LS3, and LS4 in synchronization with the PWM signals, and the current control circuits 251 may switch-control peak currents flowing through the first to fourth LED strings LS1, LS2, LS3, and LS4 in accordance with the detected peak currents. As a result, the multi-channel current control part 250 may uniformly maintain an average current (e.g., $I_{AVG}$) of each of the first to fourth LED strings LS1, LS2, LS3, and LS4.

For example, a first current control circuit 251 is connected to a second terminal of the first LED string LS1. The current control circuit 251 includes an input part 251*a*, a control transistor FET2, a filter 251*b*, and a comparator 251*c*.

The input part 251*a* includes a fourth diode D4 including an anode connected to a control electrode of the control transistor FET2 and a cathode receiving the PWM signal. The first current control circuit 251 is operated when the input part 251*a* receives a high level signal, and the first current control part 251 is not operated when the input part 251*a* receives a low level signal.

The control transistor FET2 includes an input electrode connected to a second terminal of the first LED string LS1, an output electrode connected to the filter 251*b*, and a control electrode connected to the comparator 251*c*. The control transistor FET2 is turned on when a voltage of the control electrode is greater than a threshold voltage Vth, and the control transistor FET2 is turned off when the voltage of the control electrode is less than or equal to the threshold voltage Vth.

The filter 251*b* is connected to a second terminal of the first LED string LS1 to determine a frequency of a peak current flowing through the first LED string LS1. For example, the first filter 251*b* includes a resistor R connected to an output electrode of the control transistor FET2 and a capacitor C connected to the resistor R. The filter 251*b* predicts the highest of a voltage deviation to set a value of the resistor R and a value of the capacitor C so that a frequency may be different in accordance with a voltage deviation of the LED strings. Moreover, when a time constant (RC) value is set, the inverse time constant (RC) value (e.g., 1/RC corresponding to frequency) may be set to be greater than a frequency of the PWM signal.

The filter 251*b* determines a frequency of an output signal of the control transistor FET2 corresponding to a peak current flowing through the first LED string LS1. The filter 251*b* provides the comparator 251*c* with a comparison signal $V_{FED}$ in which the frequency is determined.

The comparator 251*c* includes a reference terminal (+) receiving a reference signal $V_{REF}$ and a comparing terminal (−) receiving the comparison signal $V_{FED}$. The comparator 251*c* outputs an output signal which controls a turning-on or a turning-off of the control transistor FET2 in accordance with a comparison result of the reference signal $V_{REF}$ and the comparison signal $V_{FED}$. For example, the comparator 251*c* may output a low level signal when the comparison signal $V_{FED}$ is less than or equal to the reference signal $V_{REF}$, and may output a high level signal when the comparison signal $V_{FED}$ is greater than the reference signal $V_{REF}$.

Figure 3:
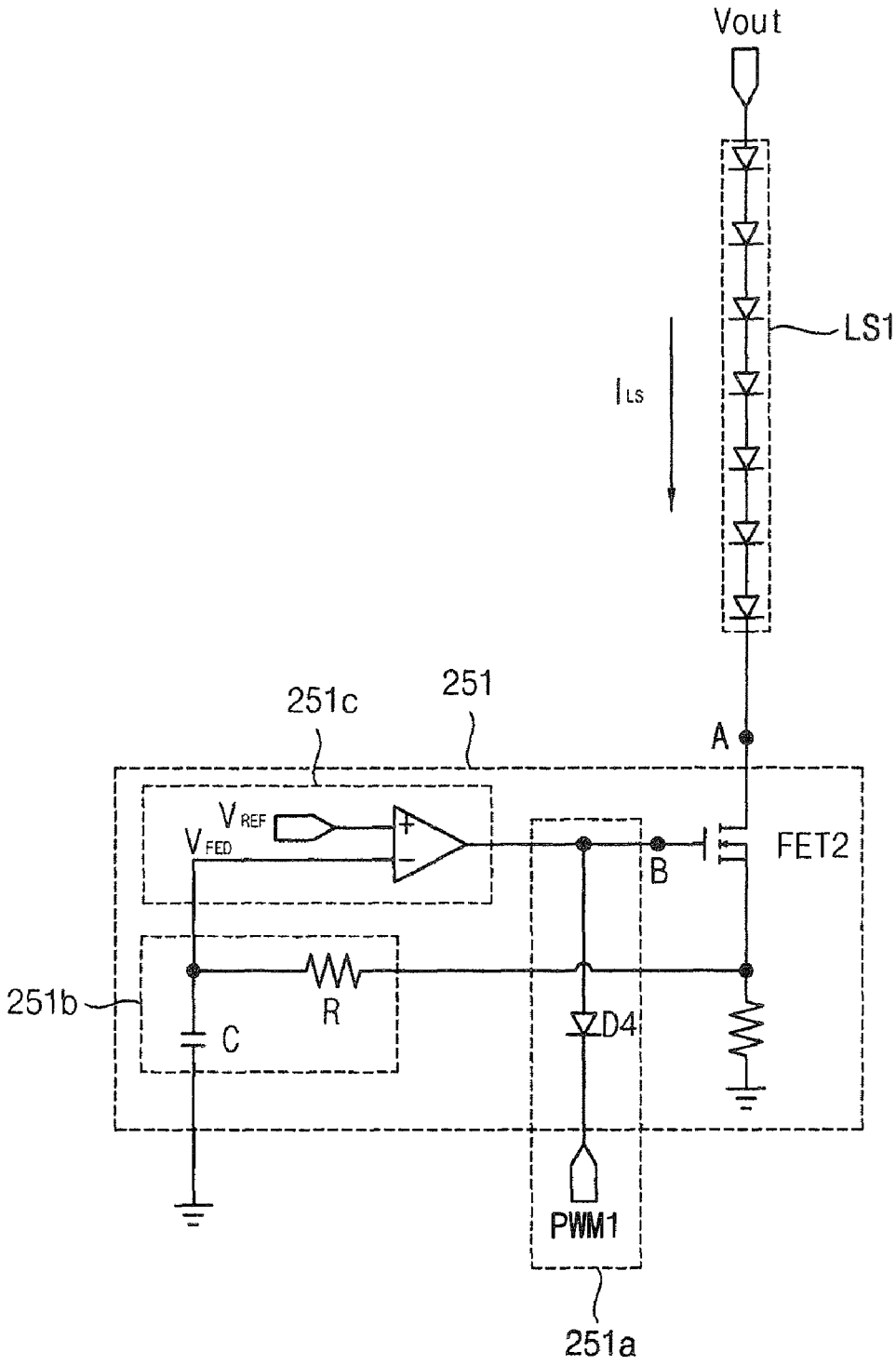
FIG. 3 is a circuit diagram illustrating a driver of the light source apparatus of FIG. 2 in accordance with an embodiment.
Figure 4A:
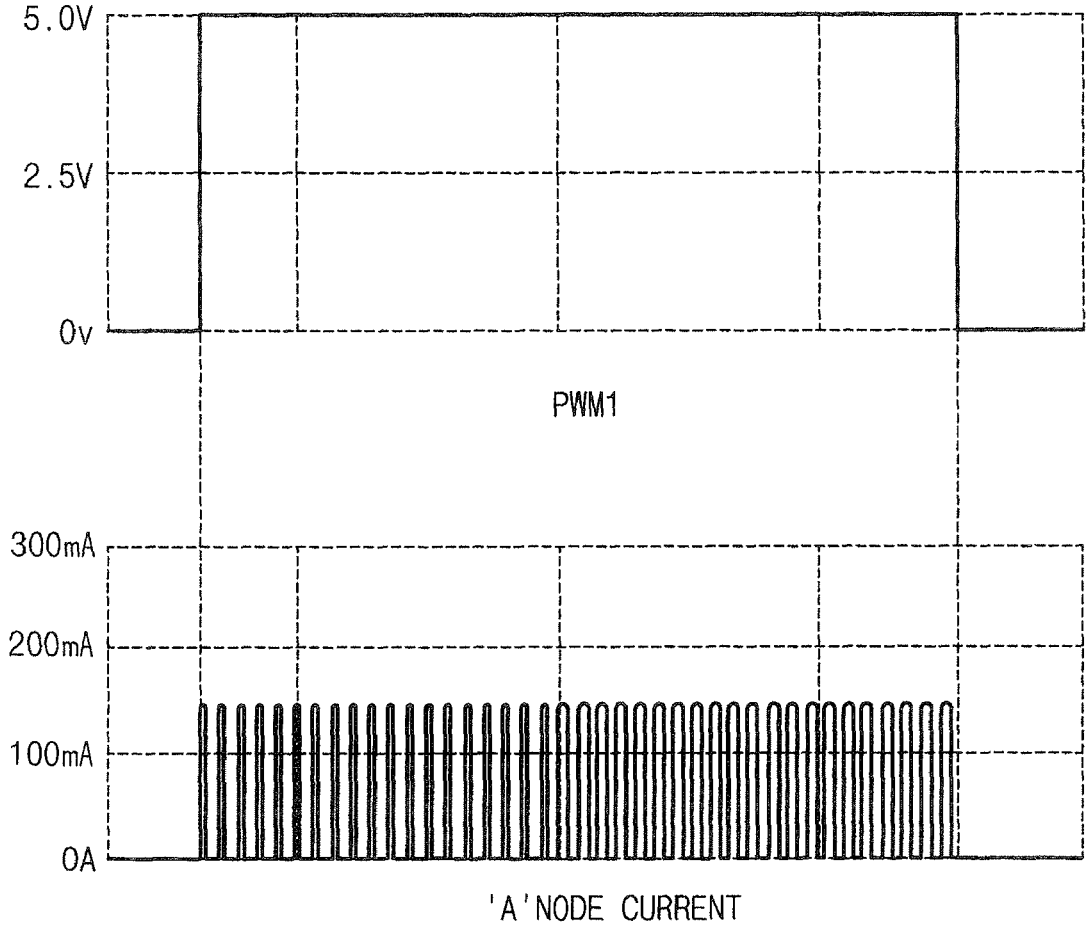
FIG. 4A and FIG. 4B are waveform diagrams showing signals of the light source apparatus of FIG. 3 in accordance with an embodiment.
Figure 4B:
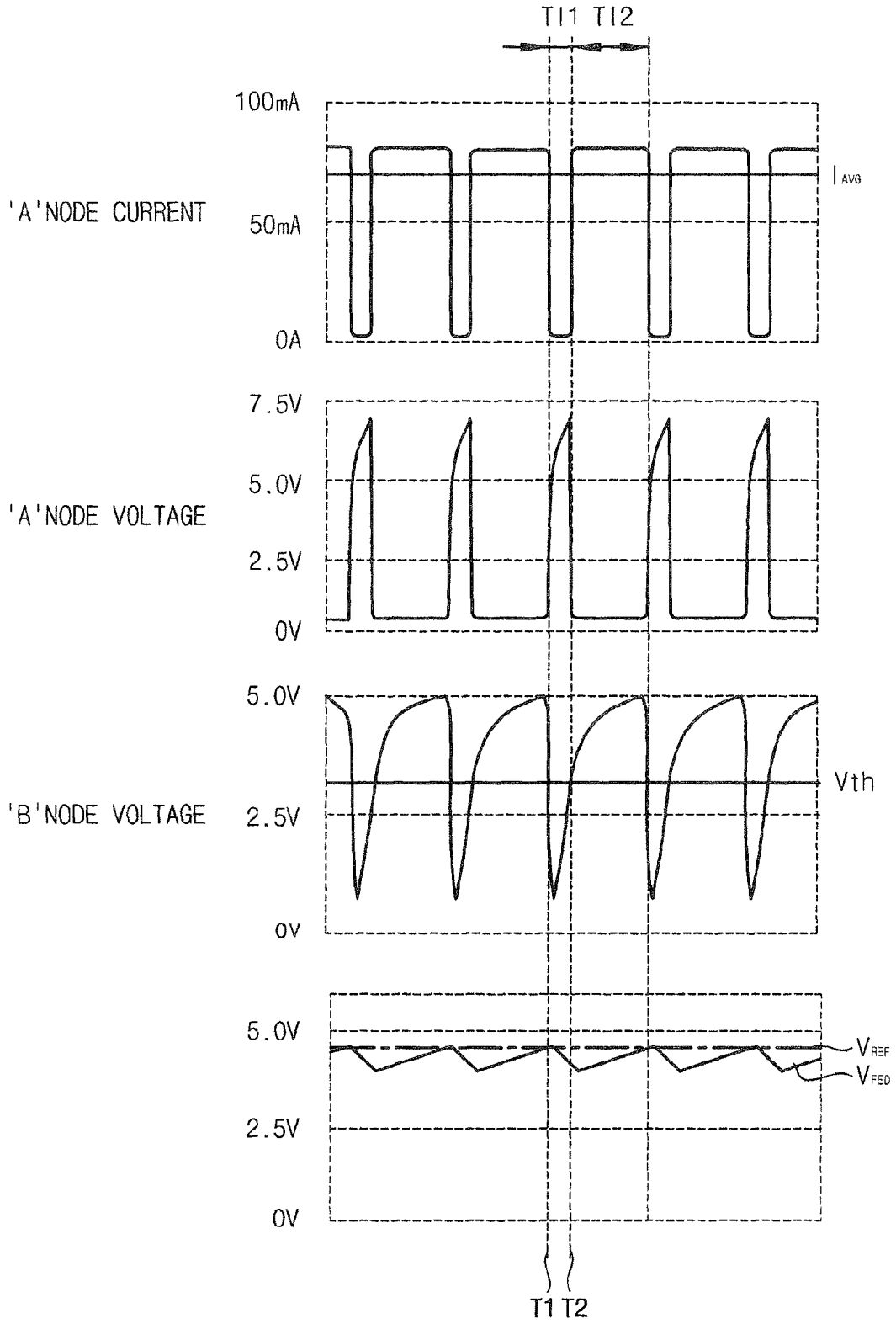

FIG. 3 is a circuit diagram illustrating a driver of the light source apparatus of FIG. 2 according to an embodiment. FIG. 4A and FIG. 4B are waveform diagrams showing signals of the light source apparatus of FIG. 3 in accordance with one or more embodiments. Referring to FIG. 2 through FIG. 4A, the light source apparatus includes a first LED string LS1 and a current control circuit 251, which controls a peak current flowing through the first LED string LS1. The current control circuit 251 includes an input part 251*a*, a control transistor FET2, a filter 251*b*, and a comparator 251*c*.

A first terminal of the first LED string LS1 receives the driving voltage Vout. The input part 251*a* receives the PWM signal PWM1. The current control circuit 251 is operated when the PWM signal PWM1 is in a high level, and the current control circuit 251 is not operated when the PWM signal PWM1 is in a low level.

A resistance deviation may be generated in the LED strings due to a design deviation of the LED strings, so that a voltage deviation may be generated in accordance with the resistance deviation. That is, a relatively high current flows through a LED string having a relatively high voltage deviation. Thus, when a voltage deviation Vf is in the first LED string LS1, a high peak current $I_{LS}$ corresponding to the voltage deviation Vf flows through the first LED string LS1.

A peak current $I_{LS}$ flowing through the first LED string LS1 is input to the filter 251*b* via the control transistor FET2. The filter 251*b* determines a frequency of the peak current $I_{LS}$ by the resistor R and the capacitor C. The peak current $I_{LS}$ by which a frequency is determined is applied to the comparing terminal (−) of the comparator 251*c* as a comparison signal $V_{FED}$. A frequency of the comparison signal $V_{FED}$ is greater than that of the PWM signal. For example, the frequency of the comparison signal $V_{FED}$ may be about 30 Hz, and that may be greater than the frequency of the PWM signal by about twenty times. Thus, when the LED string is driven by the PWM signal for dimming, the comparison signal $V_{FED}$ may not affect resolution.

The comparator 251*c* compares a reference signal $V_{REF}$ with the comparison signal $V_{FED}$. The comparator 251*c* outputs a low level signal when the comparison signal $V_{FED}$ is greater than the reference signal $V_{FED}$, and outputs a high level signal when the comparison signal $V_{FED}$ is lower than or equal to the reference signal $V_{REF}$.

For example, operation of the current control circuit 251 will be described for a case in which the input part 251*a* receives PWM signal PWM1 with PWM1 being a high level signal. Referring to FIG. 3 and FIG. 4B, at a time T1 that the comparison signal $V_{FED}$ reaches a high level greater than the reference signal $V_{REF}$, the comparison signal $V_{FED}$ is greater than the reference signal $V_{REF}$, so that the comparator 251 outputs a low level signal. A level of an output terminal ('B' node) of the comparator 251*c* is lowered to a low voltage, and a low voltage that is lower than a threshold voltage Vth is applied to a control electrode of the control transistor FET2. Therefore, the control transistor FET2 is turned off.

When the control transistor FET2 is turned off, a high voltage is applied to a second terminal ('A' node) of the first LED string LS1 connected to an input terminal of the control transistor FET2, and a peak current $I_{LS}$ does not flow. During a first interval TI1 in which the control transistor FET2 is turned off, there is not a substantial flow of a peak current $I_{LS}$ through the first LED string LS1.

Then, the comparison signal $V_{FED}$ decreases to a low level due to the determined frequency (e.g., RC time constant of filter 251*b*). The comparison signal $V_{FED}$ is less than the reference signal $V_{REF}$, so that the comparator 251*c* outputs a high level signal. After a predetermined time, at a time T2 that a high voltage that is greater than a threshold voltage Vth is applied to an output terminal of the comparator 251*c* and a control electrode of the control transistor FET2, the control transistor FET2 is turned on. When the control transistor FET2 is turned on, a low voltage is applied to a second terminal ('A' node) of the first LED string LS1 so that a peak current $I_{LS}$ flows through the first LED string LS1.

During a second interval TI2 that the control transistor FET2 is turned on, a peak current $I_{LS}$ flows through the first LED string LS1.

As a result, a turning-on or a turning-off of the control transistor FET2 is controlled by using a peak current deviation of the LED strings in accordance with a voltage deviation, so that an average current $I_{AVG}$ of the LED strings may be uniformly maintained. For example, a turning-off time of the control transistor FET2 may be increased when a peak current $I_{LS}$ flowing through the LED string is small, and a turning-off time of the control transistor FET2 may be decreased when the peak current $I_{LS}$ flowing the LED string is large. Thus, the average current $I_{AVG}$ may be uniformly maintained.

Figure 5:
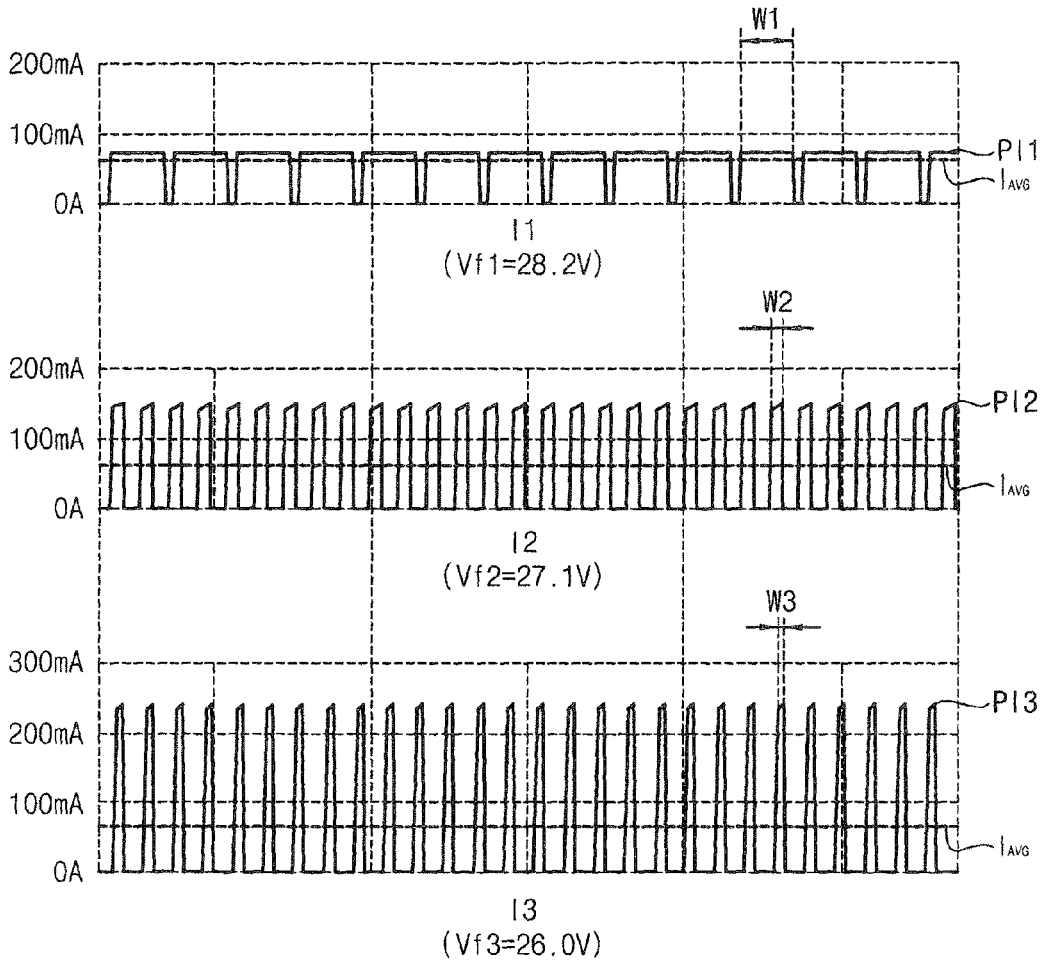
FIG. 5 is waveform diagram showing currents in accordance with a voltage variation of light source strings of FIG. 2 in accordance with an embodiment.

FIG. 5 is waveform diagram showing currents in accordance with a voltage variation of light source strings of FIG. 2 in accordance with one or more embodiments. Referring to FIG. 2 and FIG. 5, when a two-terminal voltage Vf1 of the first LED string LS1 is about 28.2 V, a two-terminal voltage Vf2 of the second LED string LS2 is about 27.1 V, and a two-terminal voltage Vf3 of the third LED string LS3 is about 26.0 V, currents flowing through the first, second, and third LED strings LS1, LS2, and LS3 were measured.

It was measured that a first peak current PI1 and a current I1 of a first frequency having a first width W1 flow through the first LED string LS1. For example, the first peak current PI1 was about 75 mA. Moreover, it was measured that a second peak current PI2 that is greater than the first peak current PI1 and a current I2 of a second frequency having a second width W2 that is less than the first width W1 flow through the second LED string LS2. For example, the second peak current PI2 was about 150 mA. Furthermore, it was measured that a third peak current PI3 that is greater than the second peak current PI2 and a current I3 of a third frequency having a third width W3 that is less than the second width W2 flow through the third LED string LS3. For example, the third peak current P13 was about 230 mA.

The first to third currents I1, I2, and I3 have the same average current $I_{AVG}$. For example, the average current $I_{AVG}$ was about 65 mA.

Thus, the different peak currents are flowing through the LED strings in accordance with a voltage deviation of the LED strings; but the peak currents are controlled by switching (e.g., switching the control transistor FET2), however, so that the same average current may flow through the different LED strings, e.g., LED strings LS1, LS2, and LS3. Thus, an average current may be uniformly maintained with regard to the different LED strings.

As described above, according to embodiments of the present invention, a peak current flowing through light source strings in accordance with a voltage deviation of the light source strings is switch-controlled, so that an average current of the light source strings may be uniformly maintained. Therefore, a voltage deviation is not consumed as power, so that damage to circuit elements due to heat may be prevented.

The foregoing is illustrative of embodiments in accordance with the present disclosure of invention and is not to be construed as limiting thereof. Although a few example embodiments in accordance with the present invention have been described, those skilled in the art will readily appreciate from the foregoing that many modifications are possible in the example embodiments without materially departing from the novel teachings and advantages of the present disclosure. Accordingly, all such modifications are intended to be included within the scope of the present teachings. In the claims, means-plus-function clauses are intended to cover the structures described herein as performing the recited function and not only structural equivalents but also functionally equivalent structures. Therefore, it is to be understood that the foregoing is illustrative of the present disclosure of invention and is not to be construed as limited to the specific example embodiments disclosed, and that modifications to the disclosed example embodiments, as well as other example embodiments, are intended to be included within the scope of the teachings.

What is claimed is:

1. A method of driving a light source having a plurality of light source strings, the method comprising:

driving the plurality of light source strings with a driving voltage applied to a common first terminal of the light source strings; and for each respective light source string, determining an over-time integral of current passed through the respective light source string and based on the determined integral, switch-controlling wise limiting a duration of when peak current passes through the respective light source string so as to thereby maintain a predetermined average current in each respective one of the light source strings.

2. The method of claim 1, wherein the maintaining of the predetermined average current in each respective one of the light source strings is carried out in synchronization with a respective one of a plurality of dimming signals respectively provided for controlling a luminance of each respective one of the light source strings.

3. The method of claim 2, wherein for each respective light source string, the corresponding switch-controlling wise limiting of the duration of when peak current passes through has a frequency that is greater than a maximum switching frequency used for the respective one of the dimming signals.

4. A light source apparatus comprising:

a light source module comprising a plurality of light source strings that are connected to receive a driving voltage through a common first terminal thereof; and a multi-channel current control part having a plurality of control lines respectively connected to respective second terminals of each of the light source strings, the multi-channel current control part including a plurality of current control circuits adapted to switch-control wise limit respective durations of when respective peak currents pass through the respective light source strings so as to thereby maintain a predetermined average current in each respective one of the light source strings.

5. The light source apparatus of claim 4, wherein:

each of the current control circuits is adapted to limit a flowing time of the respective peak current of the light string in response to an over-time integral of the respective peak current of the respective light source string rising to hit a predetermined limit level.

6. The light source apparatus of claim 5, wherein each of the current control circuits comprises:

a filter connected to the respective second terminal of the respective one of the light source strings, the filter adapted to determine an over-time integral of the respective peak current flowing through the respective light source string so as to output a comparison signal by which duration of the peak flow is determined;

a control transistor comprising an input electrode connected to the second terminal of the respective light source string and an output electrode connected to the filter; and a comparator adapted to output an output signal to a control electrode of the control transistor, the output signal controlling a turn-on or a turn-off of the control transistor in accordance with a comparison result of a reference signal and the comparison signal.

7. The light source apparatus of claim 6, wherein the current control circuit further comprises an input part connected to an output terminal of the comparator and a control electrode of the control transistor to receive a dimming signal controlling a luminance of the light source string.

8. The light source apparatus of claim 7, wherein for each respective light source string, the corresponding switch-controlling wise limiting of the duration of when peak current passes through has a frequency greater than a maximum switching frequency used for the respective one of the dimming signals.

9. The light source apparatus of claim 7, further comprising:

a multi-channel voltage detecting part connected to the second terminals of the light source strings to detect a detection voltage from the light source strings; and a light source driving part adapted to control a generation of the driving voltage in accordance with the detection voltage.

10. The light source apparatus of claim 9, wherein:

the multi-channel voltage detecting part comprises a plurality of detection circuits connected to second terminals of the light source strings, and wherein:

each of the detection circuits comprises:

a resistor connected to a second terminal of each of the light source strings;

a diode connected to the resistor; and an input part connected to the resistor and the diode to receive the dimming signal.

11. A display apparatus comprising:

a display panel adapted to display an image;

a light source module comprising a plurality of light source strings that are connected to receive a driving voltage through a common first terminal thereof; and a multi-channel current control part having a plurality of control lines respectively connected to respective second terminals of each of the light source strings, wherein the multi-channel current control part includes a plurality of current control circuits adapted to switch-control wise limit respective durations of when respective peak currents pass through the respective light source strings so as to thereby maintain a predetermined average current in each respective one of the light source strings.

12. The display apparatus of claim 11, wherein the multi-channel current control part comprises a plurality of current control circuits and each current control circuit comprises:

a filter connected to a second terminal of a first one of the light source strings, the filter adapted to determine a frequency of the peak current flowing through the first light source string to output a comparison signal by which the frequency is determined;

a control transistor comprising an input electrode connected to the second terminal of the first light source string and an output electrode connected to the filter; and a comparator adapted to output an output signal to a control electrode of the control transistor, the output signal controlling a turn-on or a turn-off of the control transistor in accordance with a comparison result of a reference signal and the comparison signal.

13. The display apparatus of claim 12, wherein the current control circuit further comprises an input part connected to an output terminal of the comparator and a control electrode of the control transistor to receive a dimming signal controlling a luminance of the light source string.

14. The display apparatus of claim 13, wherein for each respective light source string, the corresponding switch-controlling wise limiting of the duration of when peak current passes through has a frequency greater than a maximum switching frequency used for the respective one of the dimming signals.

15. The display apparatus of claim 13, further comprising:

a multi-channel voltage detecting part connected to the second terminals of the light source strings to detect a detection voltage from the light source strings; and a light source driving part adapted to control a generation of the driving voltage in accordance with the detection voltage.

16. The display apparatus of claim 15, wherein:

the multi-channel voltage detecting part comprises a plurality of detection circuits connected to second terminals of the light source strings, and wherein:

each of the detection circuits comprises:

a resistor connected to a second terminal of each of the light source strings;

a diode connected to the resistor; and an input part connected to the resistor and the diode to receive the dimming signal.

17. A light source apparatus comprising:

a light source module comprising a plurality of light source strings that are connected in parallel, the light source strings adapted to receive a driving voltage through a first terminal thereof; and a multi-channel current control part connected to a second terminal of each of the light source strings, the multi-channel current control part adapted to switch-control a peak current due to a voltage deviation of the light source strings to uniformly maintain an average current of the light source strings, wherein:

the multi-channel current control part comprises a plurality of current control circuits connected to the light source strings, and each of the current control circuits comprises:

a filter connected to a second terminal of a first one of the light source strings, the filter adapted to determine a frequency of the peak current flowing through the first light source string to output a comparison signal by which the frequency is determined;

a control transistor comprising an input electrode connected to the second terminal of the first light source string and an output electrode connected to the filter; and a comparator adapted to output an output signal to a control electrode of the control transistor, the output signal controlling a turn-on or a turn-off of the control transistor in accordance with a comparison result of a reference signal and the comparison signal.

18. A display apparatus comprising:

a display panel adapted to display an image;

a light source module comprising a plurality of light source strings that are connected in parallel, the light source strings adapted to receive a driving voltage through a first terminal thereof; and a multi-channel current control part connected to a second terminal of each of the light source strings and adapted to uniformly maintain an average current of each of the light source strings by switch-controlling a peak current due to a voltage deviation of the light source strings, wherein:

the multi-channel current control part comprises a plurality of current control circuits connected to the light source strings, and each of the current control circuits comprises:

a filter connected to a second terminal of a first one of the light source strings, the filter adapted to determine a frequency of the peak current flowing through the first light source string to output a comparison signal by which the frequency is determined;

a control transistor comprising an input electrode connected to the second terminal of the first light source string and an output electrode connected to the filter; and a comparator adapted to output an output signal to a control electrode of the control transistor, the output signal controlling a turn-on or a turn-off of the control transistor in accordance with a comparison result of a reference signal and the comparison signal.

* * * * *